US012246905B2

(12) United States Patent
Nelson et al.

(10) Patent No.: US 12,246,905 B2
(45) Date of Patent: Mar. 11, 2025

(54) SOFT-SIDED COOLER

(71) Applicant: Bass Pro Intellectual Property, L.L.C., Springfield, MO (US)

(72) Inventors: Ronald D. Nelson, Sidney, NE (US); David P. Leif, Springfield, MO (US); Lucas C. Humphreys, Sidney, NE (US)

(73) Assignee: Bass Pro Intellectual Property, L.L.C., Springfield, MO (US)

( * ) Notice: Subject to any disclaimer, the term of this patent is extended or adjusted under 35 U.S.C. 154(b) by 52 days.

(21) Appl. No.: 18/309,509

(22) Filed: Apr. 28, 2023

(65) Prior Publication Data

US 2023/0348171 A1 Nov. 2, 2023

Related U.S. Application Data

(60) Provisional application No. 63/337,098, filed on Apr. 30, 2022.

(51) Int. Cl.

| | |
|---|---|
| ***B65D 81/38*** | (2006.01) |
| ***B65D 43/16*** | (2006.01) |
| ***B65D 43/22*** | (2006.01) |

(52) U.S. Cl.

CPC ..... *B65D 81/3823* (2013.01); *B65D 43/163* (2013.01); *B65D 43/22* (2013.01)

(58) Field of Classification Search

CPC .. B65D 81/3823; B65D 43/163; B65D 43/22; B65D 43/16; B65D 43/169; A45C 11/20; F25D 11/003; F25D 3/08; A47G 23/04

USPC ..... 220/592.2

See application file for complete search history.

(56) References Cited

U.S. PATENT DOCUMENTS

| | | | | |
|---|---|---|---|---|
| 2003/0042264 | A1* | 3/2003 | Stanwix | F25D 23/065 220/592.21 |
| 2012/0012602 | A1* | 1/2012 | Everson | B65D 43/162 220/810 |
| 2017/0334614 | A1* | 11/2017 | Herlin | B65D 51/20 |
| 2023/0202740 | A1* | 6/2023 | Liao | B65D 21/086 220/592.2 |

FOREIGN PATENT DOCUMENTS

WO WO-2018218224 A1 * 11/2018

* cited by examiner

*Primary Examiner* — Don M Anderson
*Assistant Examiner* — Laura E. Parker
(74) *Attorney, Agent, or Firm* — Dinsmore & Shohl LLP

(57) ABSTRACT

A soft-sided cooler includes a flexible exterior shell, and a lower frame member secured to the upper edge of the exterior shell. A lid is pivotally mounted on the lower frame member with at least one hinge. A latch is mounted on the lower fame member, opposite from the hinge. The surface of at least one of the lid or the upper frame member smoothly slope outwardly toward the other then inwardly away from the other on either side of the latch, peaking at a point intermediate the latch and the hinge, to increase the sealing force between the lid and the upper frame one each side of the cooler, between the latch and the at least one hinge.

10 Claims, 7 Drawing Sheets

SOFT-SIDED COOLER

CROSS-REFERENCE TO RELATED APPLICATIONS

The present application claims priority to U.S. Provisional Patent Application No. 63/337,098 filed Apr. 30, 2022, the entire content of which is incorporated herein by reference.

FIELD

The present disclosure relates to coolers for keeping food and beverages cool, and in particular to a soft-side cooler with a latch that can be operated with one hand.

BACKGROUND

This section provides background information related to the present disclosure which is not necessarily prior art.

Soft-sided coolers are popular because their flexible walls make the cooler light weight, accommodative of oddly shaped contents, and, often, collapsible. While the soft sides of the cooler provide benefits, they can make it difficult to access the interior of the cooler. Attempts have been made to provide a latch for soft-sided coolers that is operable by one hand, but the flexibility of the soft-sided cooler has made this difficult. A rigid frame and a rigid lid allow for the mounting of a latch on a soft-sided cooler but without the support of rigid walls, the frame and lid flex enough that leaks can occur at intermediate points between the location of the of the latch and the location of the hinge.

SUMMARY

This section provides a general summary of the disclosure, and is not a comprehensive disclosure of its full scope or all of its features.

Embodiments of this disclosure provide a soft-sided cooler with a latch operable with one hand for convenient access to the interior. In a preferred embodiment, a soft-sided cooler comprises a flexible exterior shell having a bottom and a sidewall projecting upwardly from the bottom to an upper edge. A lower frame member secured to the upper edge of the sidewall of the exterior shell. A flexible interior liner having a bottom and a sidewall projecting upwardly from the bottom to an upper edge is disposed inside the exterior shell. An upper frame member is secured to the upper edge of the sidewall of the interior liner. A seal member is disposed between the upper and lower frame members.

A lid is hingedly mounted on the lower frame member, and is operable between a closed position in which the lid seals with the upper frame member, and an open position in which the interior liner of the cooler is accessible. A latch is mounted on the lower frame member, generally opposite from and intermediate the hinge, for releasably engaging the lid against the upper frame member. In accordance with the principles of one embodiment, the downwardly facing surface of the lid or the upwardly facing surface of the upper frame member gradually slopes outwardly from its respective surface on each side of the latch to a peak at a location intermediate the latch and the hinges, and from the peak at the intermediate location sloping inward toward its respective surface, wherein the peak at the intermediate location increases the sealing force between the upper frame member and lid on either side of the latch between the latch and the hinges.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
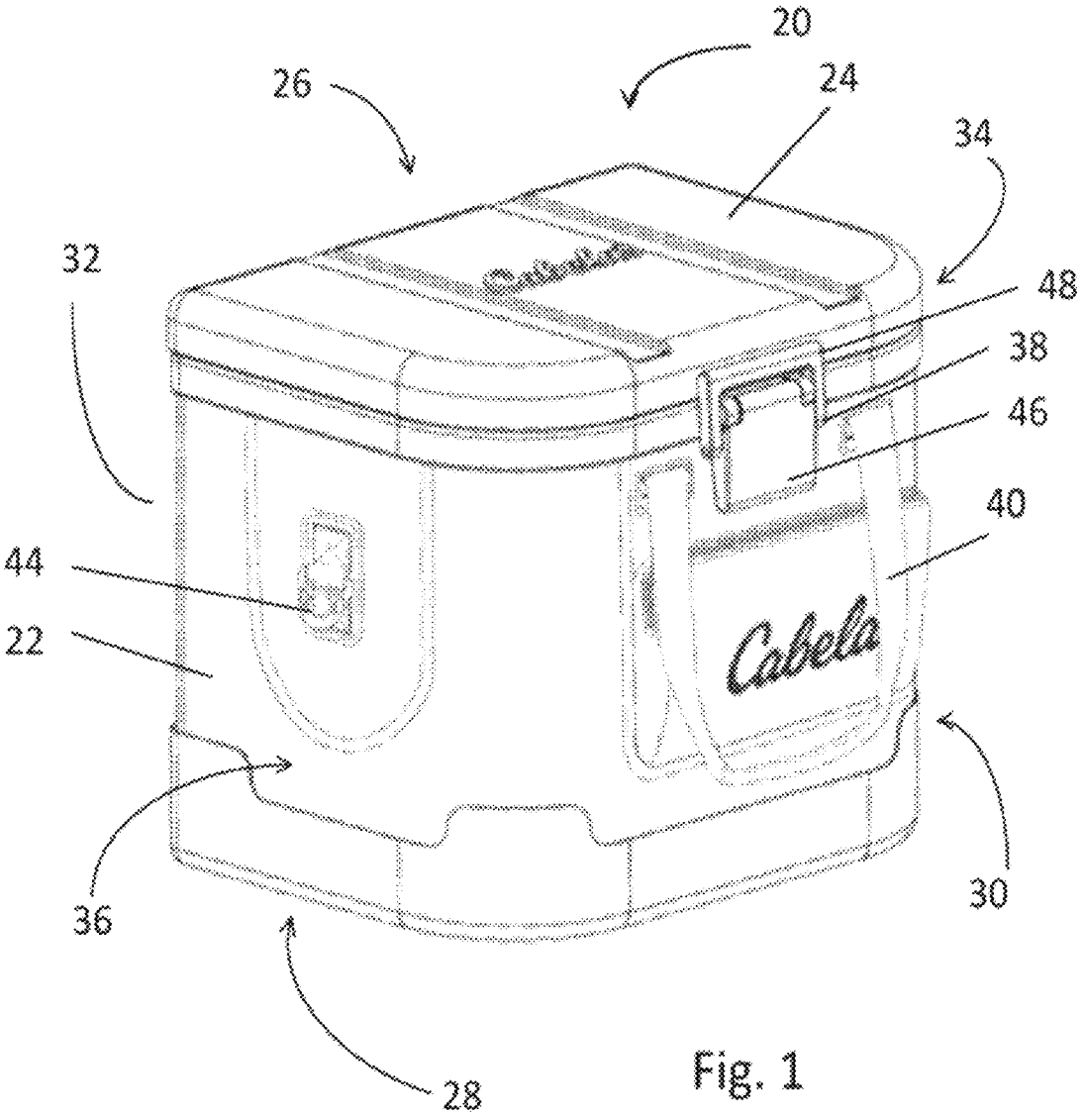
FIG. 1 is a perspective view of a soft-sided cooler according to a preferred embodiment of this disclosure.
Figure 2:
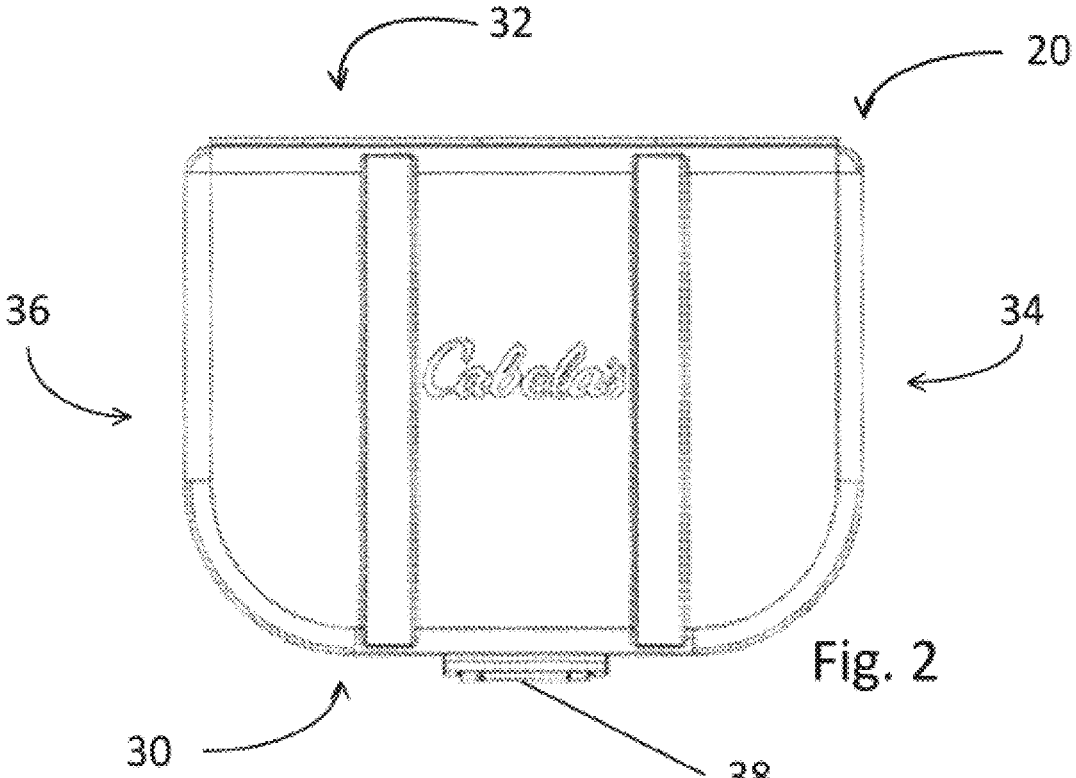
FIG. 2 is a top plan view of the soft-sided cooler shown in FIG. 1.
Figure 3:
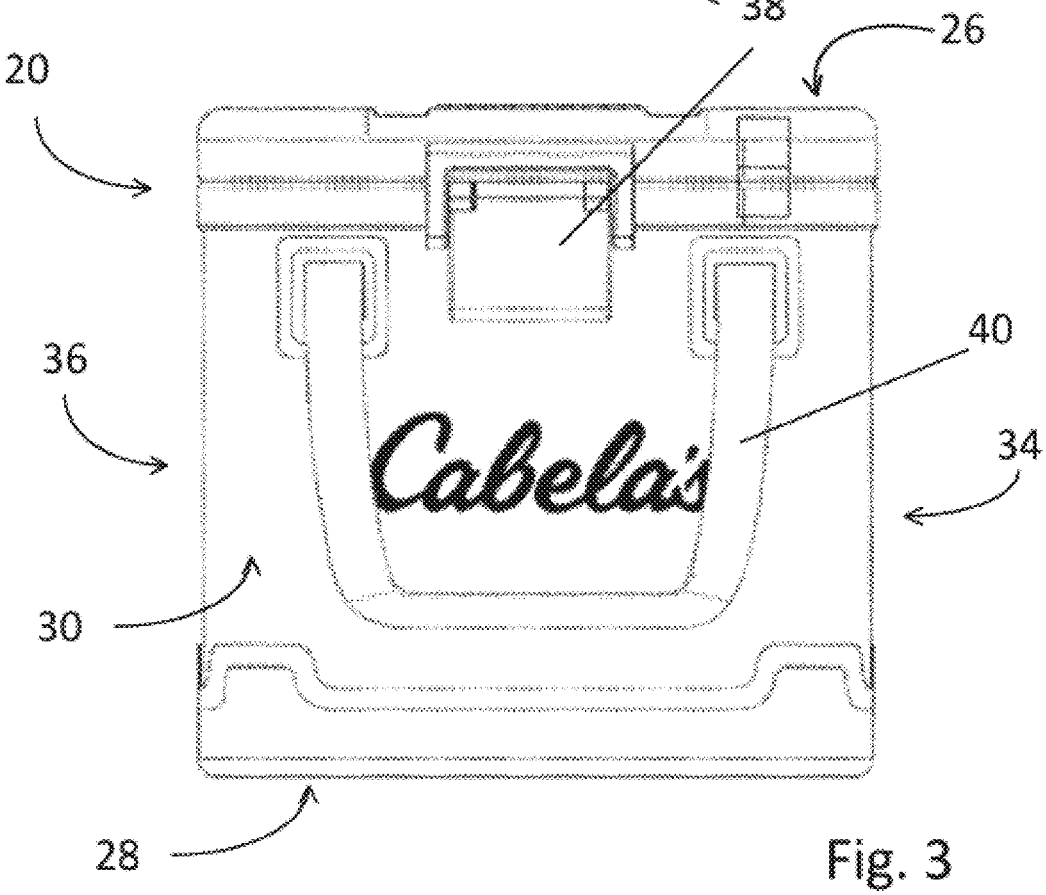
FIG. 3 is a front elevation view of the soft-sided cooler shown in FIG. 1.
Figure 4:
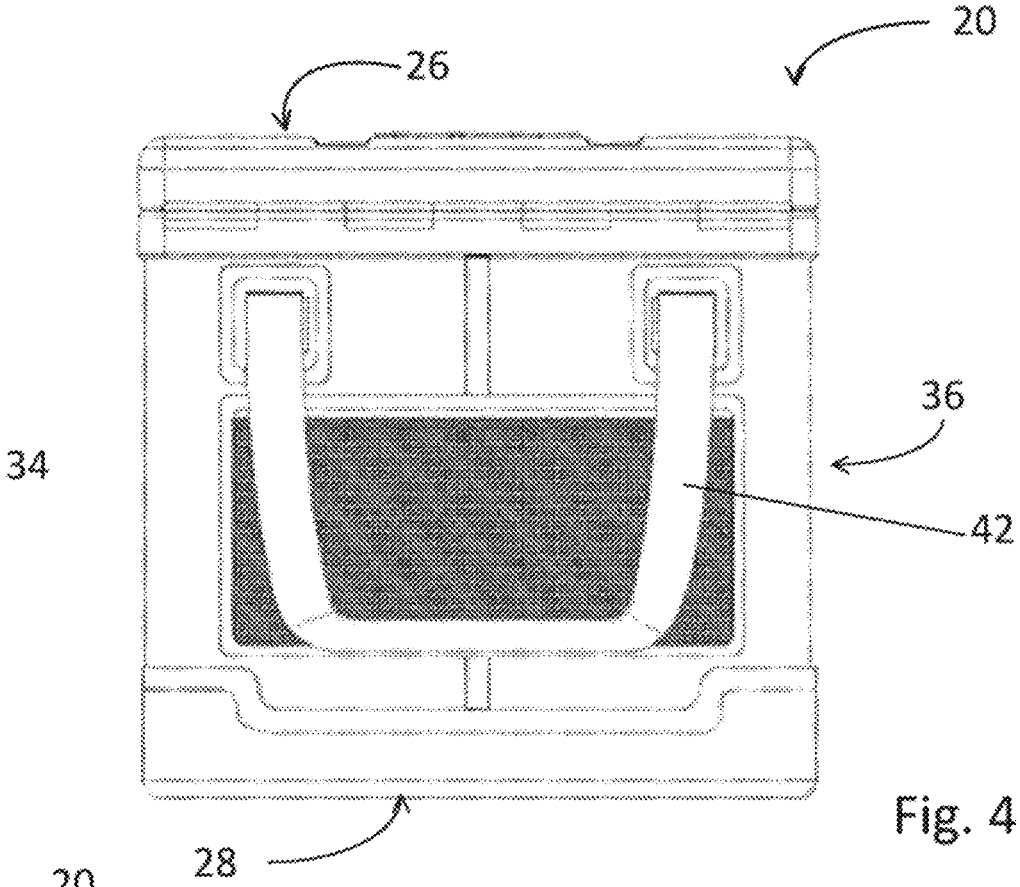
FIG. 4 is a rear elevation view of the soft-sided cooler shown in FIG. 1.

Example embodiments will now be described more fully with reference to the accompanying drawings.

A soft-sided cooler constructed according to the principles of a first preferred embodiment of this disclosure is indicated generally as 20 in FIGS. 1-5. Cooler 20 has a body 22 and a hinged lid 24, with a top 26 (FIG. 2), a bottom 28, a front face 30 (FIG. 3), a rear face 32 (FIG. 4), a right side face 34 (FIG. 5), and a left side face 36 (which is preferably a mirror image of the right side face shown in FIG. 5).

Figure 5:
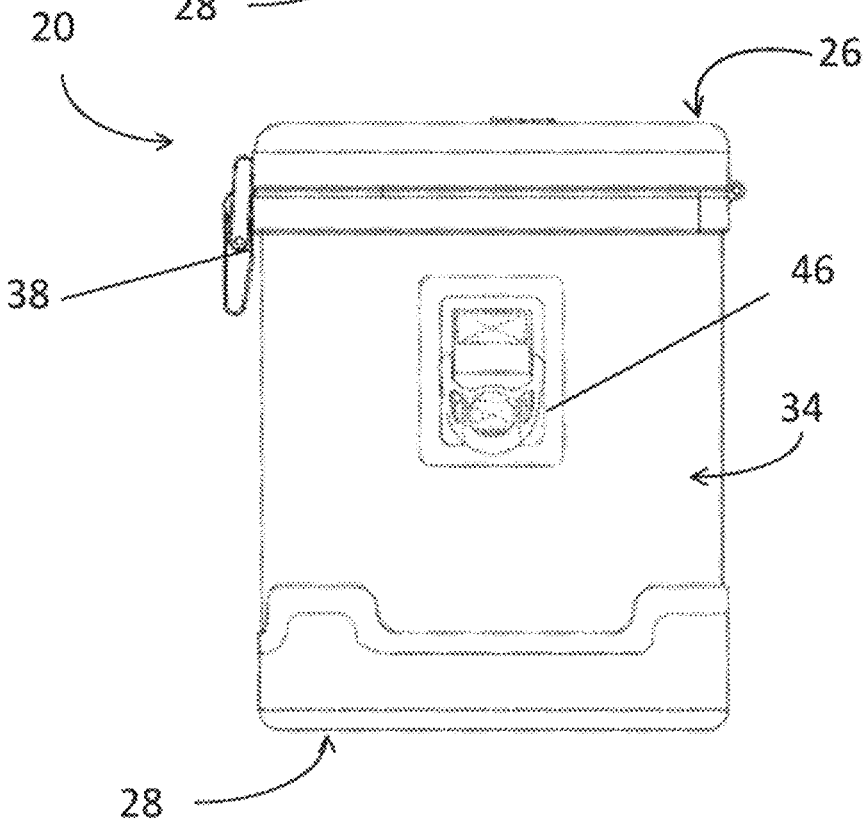
FIG. 5 is a right side elevation view of the soft-sided cooler shown in FIG. 1, the left side elevation view being a mirror image thereof.

An over-center latch mechanism 38 releasably secures the lid 24 to the body 22. Front and rear carry loops 40 and 42 are mounted on the front face 30 and rear face 32. Various types mounting rings can be mounted on the right and left side faces 34 and 36, such as D-ring 44 on the left side face 36 as shown in FIG. 1, or ring 46 on the right side face 34 as shown in FIG. 5. Of course, some other types of mounting rings can be used, if desired. The mounting rings can be the same on each side, or they can be different (as shown).

The latch mechanism 38 can be a conventional over-center latch comprising a pivotally mounted tab 46, and an inverted U-shaped catch 48 on the tab, which can engage a lip 50 on the lid 24, and pulls the lid against the body 22, and the tab is pivoted downwardly against the body.

Figure 6:
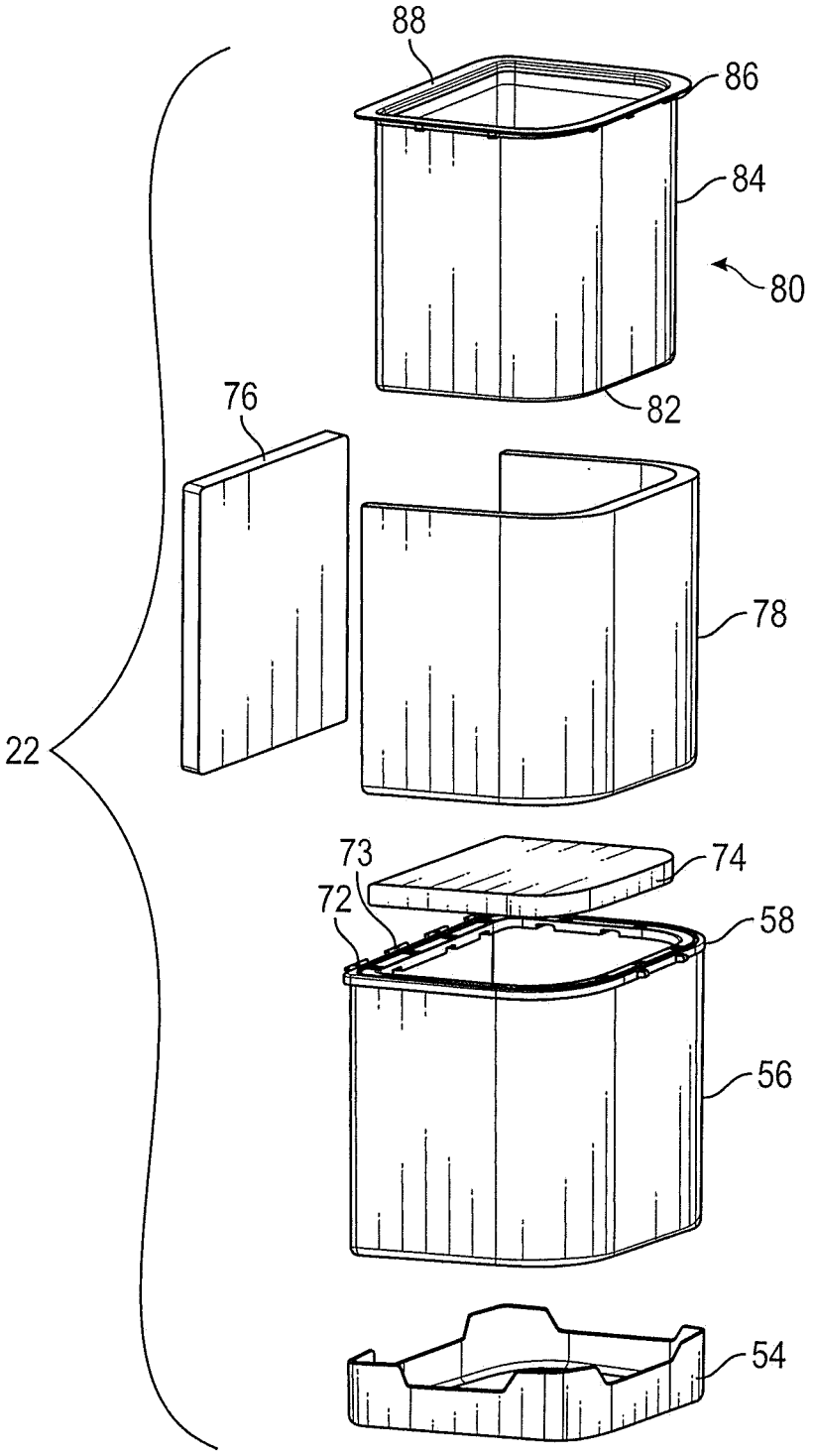
FIG. 6 is an exploded schematic view of the soft-sided cooler shown in FIG. 1.
Figure 7:
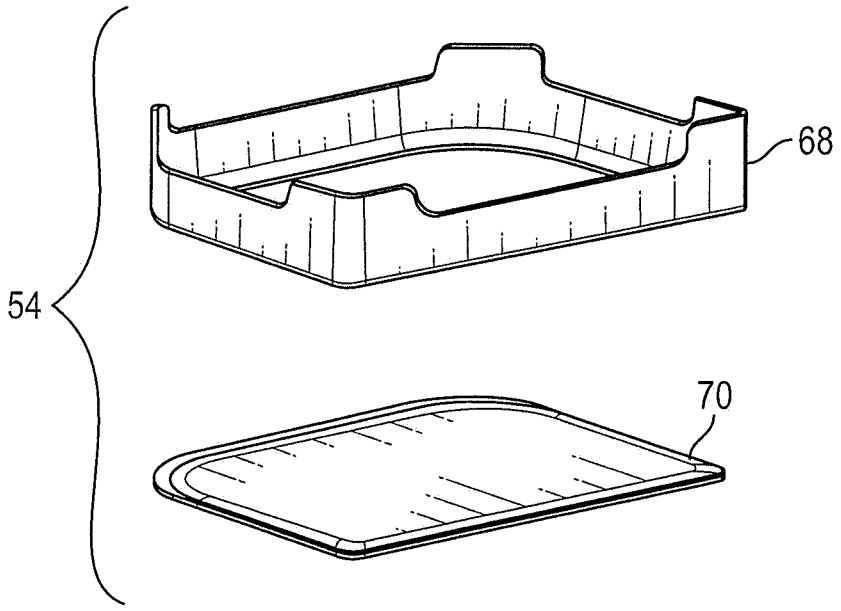
FIG. 7 is an exploded schematic view of the bottom construction of the soft-sided cooler shown in FIG. 1.

As shown in FIG. 6, the body 22 of the cooler 20 has an exterior shell comprising a bottom section 54, a flexible side wall 56 surrounding an interior space of the cooler and extending upward from the bottom section ending in an upper edge 58. As shown in FIG. 7, the bottom section 54 comprises a relatively rigid bottom frame 68 and a bottom panel 70, secured, for example with heat welding, adhesive, or other suitable means. Referring again to FIG. 6, a lower frame member 72 is secured to the upper edge 58 of the sidewall 56, for example with heat welding, ultrasonic welding or an adhesive. In this preferred embodiment, a plurality of insulating panels can be provided inside the side wall 56 of the exterior shell, and comprise a bottom insulating panel 74, a rear insulating panel 76, and a curved front insulating panel 78 that also extends along the sides so that the insulating panels substantially surround an interior space formed in the body 22.

Figure 8:
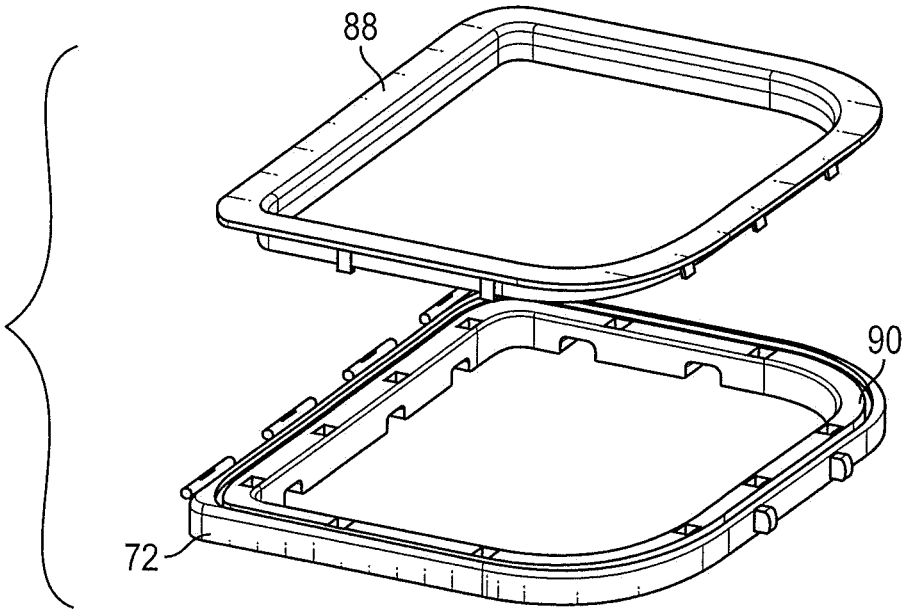
FIG. 8 is an exploded schematic view of the upper and lower frames of the soft-sided cooler.

A flexible, waterproof interior liner 80 is disposed in the interior space in the body 22, surrounded by the insulating panels. The liner 80 has a bottom 82 and a sidewall 84 projecting upwardly from the bottom to an upper edge 86. An upper frame member 88 is secured to the upper edge 86, for example with heat welding, ultrasonic welding or an adhesive. As shown in FIG. 8, the upper and lower frame members 88 and 72 interfit, with a seal member 90 disposed between them. The upper surface of the upper frame member forms a seat surface 92 facing towards the lid 24. The seat surface 92 forms a perimeter around the opening in the bottom of the cooler and sealingly engages the lid 24, as described below.

Figure 9:
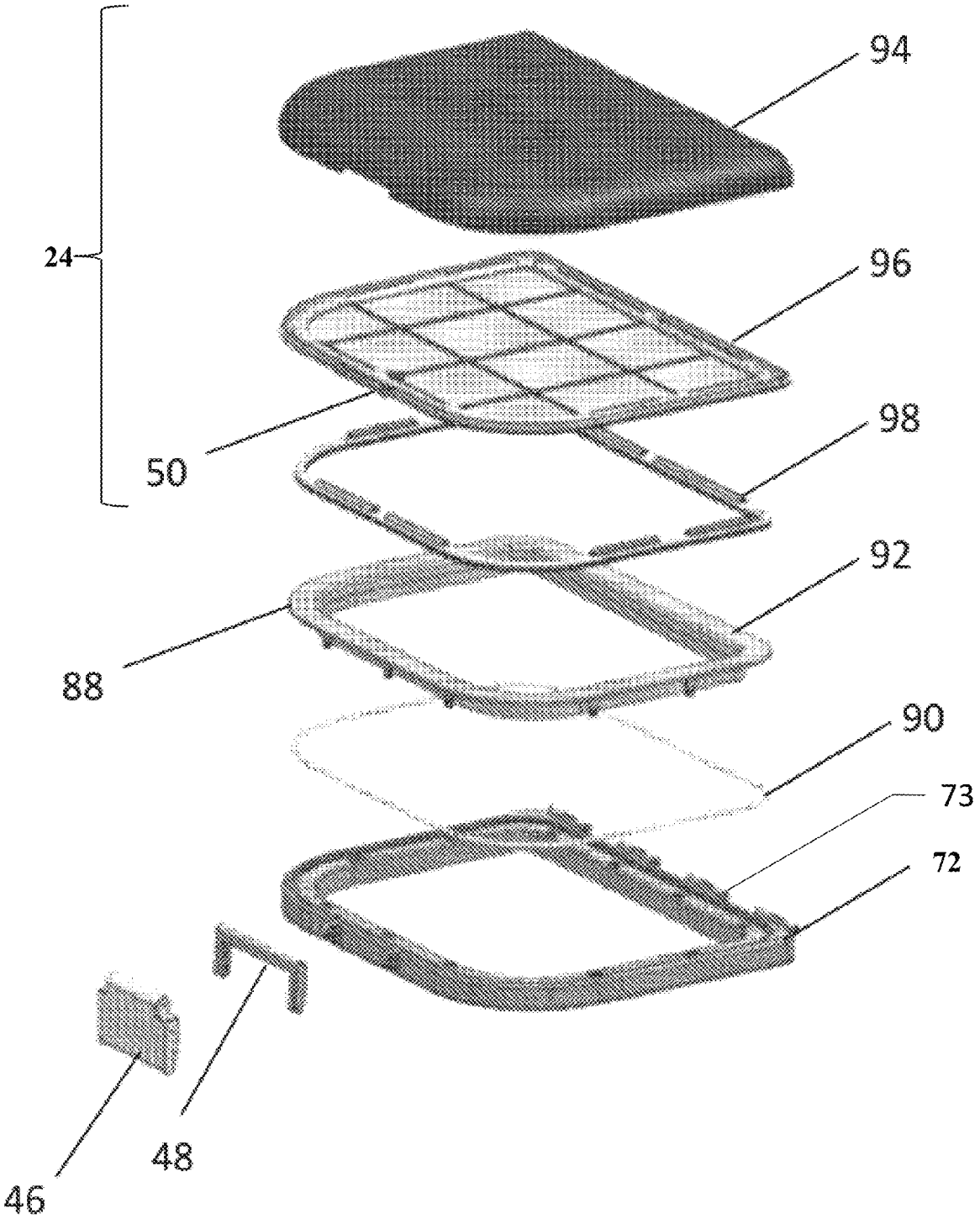
FIG. 9 is an exploded schematic view of the latch and seal assembly of the soft-sided cooler.

As shown in FIG. 9, the lid 24 preferably comprises an outer lid member 94 and an inner lid member 96. The lid 24 is hingedly connected to the lower frame member by a hinge 73. The inner lid member 96 preferably includes the lip 50 that is engaged by the U-shaped catch 48 on the tab 46. A lid sealing member 98 is mounted on the bottom face of the inner lid member 96 and along the perimeter of the inner lid member 96. A lid sealing member surface of the lid sealing member 98 faces towards seat surface 92 and sealingly engages the seat surface 92 of the body of the cooler when the lid is closed against the body of the cooler. In accordance with the principles of this disclosure, portions of the seat surface 92 project further outwardly toward the lid 24 than others, and/or portions of the lid (and in particular portions of the lid sealing member surface of the lid sealing member 98) project outwardly toward the seat surface 92 further than others to provide increased sealing force between the lid 24 and the upper frame member 88 in the areas between the latch member and the hinge 73 on each side of the cooler.

Figure 10:
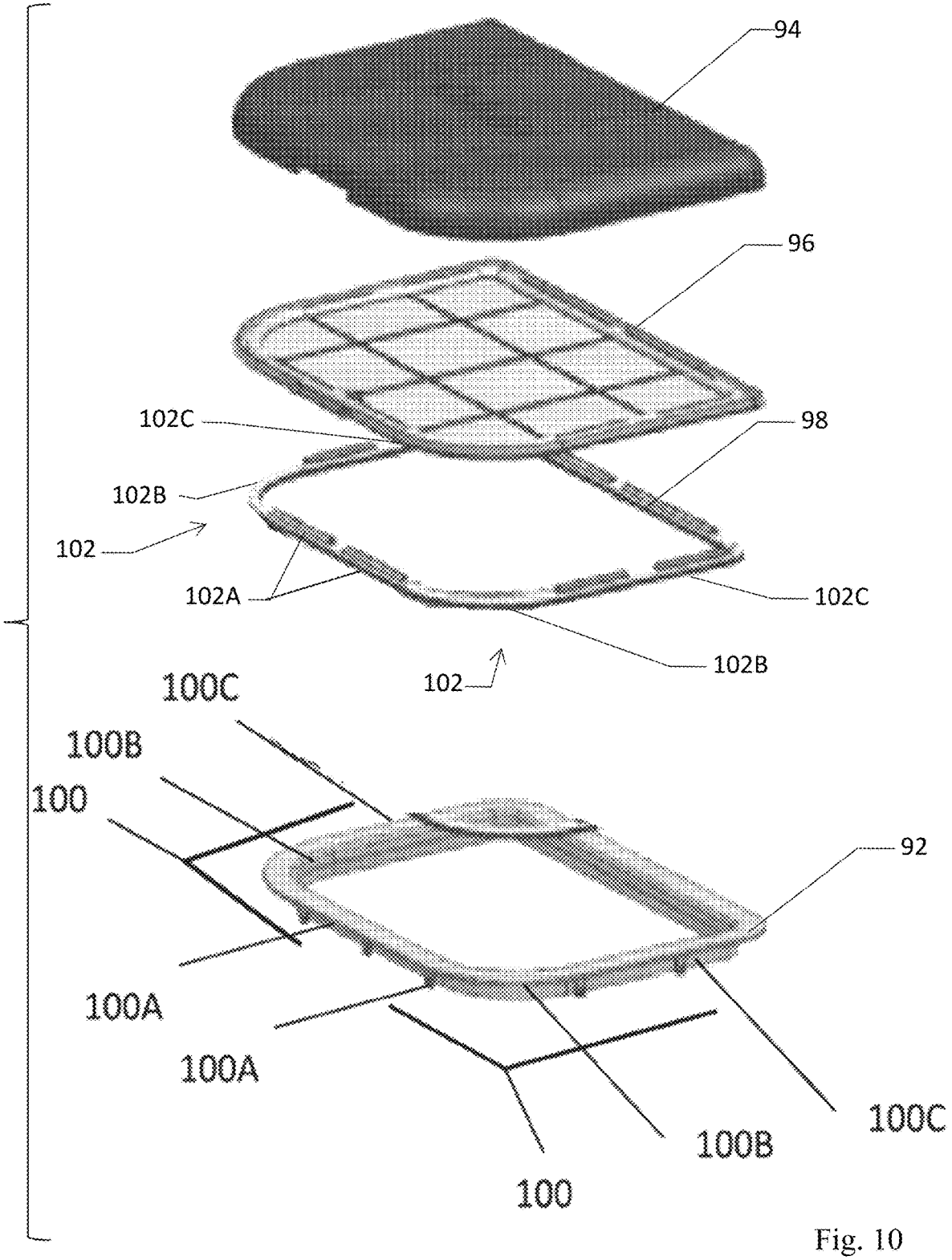
FIG. 10 is an enlarged view of a portion of FIG. 9.

For example, as shown in FIG. 10, in the regions 100 on either side of the latch, the seat surface 92 may beginning at point 100A slope gradually outwardly toward the lid sealing member 98 until points 100B, and then slope gradually inwardly until points 100C, thereby forming two gradual peaks pointing toward the lid sealing member surface of the lid sealing member 98 and located along the seat surface 92 on opposite sides of the latch. Alternatively, or in addition, in the regions 102 on either side of the latch, portions of the lid sealing member surface of lid sealing member 98 may beginning at point 102A slope gradually outwardly to points 102B, and then slope gradually inwardly to points 102C, thereby forming two gradual peaks pointing toward the seat surface 92 and located along the lid sealing member surface on opposite sides of the latch. These outwardly projecting portions (also referred to as peaks) in areas 100 and 102 improve the sealing contact force between the lid 24 and the seat surface 92 of the upper frame member 88 between the latch and the hinge, where flexing of the soft-sided cooler might otherwise cause leaks. The varying geometry of the surface 90 and/or the sealing member 96 achieves a more constant contact pressure around the perimeter of the of the cooler, rather than having areas of high pressure adjacent the latch and the hinges, and lower pressure between the latch and the hinges.

Thus a soft-sided cooler can be securely and sealingly opened and closed with a simple latch that can be operated with one hand.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A soft-sided cooler comprising:

a flexible exterior shell having a bottom and a sidewall projecting upwardly from the bottom to an upper edge;

a lower frame member secured to the upper edge of the sidewall of the exterior shell;

a flexible interior liner having a bottom and a sidewall projecting upwardly from the bottom to an upper edge;

an upper frame member secured to the upper edge of the sidewall of the flexible interior liner and comprising a seat surface;

a seal member between the upper and lower frame members;

a lid pivotally mounted on the lower frame member with at least one hinge, and pivotable between a closed position, and an open position in which the interior of the cooler is accessible, the lid comprising a lid sealing member surface facing toward the seat surface of the upper frame member; and a latch mounted on the lower frame member opposite from the at least one hinge, the latch releasably securing the lid against the upper frame member;

wherein at least one of the seat surface and the lid sealing member surface smoothly slope outwardly toward the other then inwardly away from the other forming a peak on opposite sides of the latch, the peak on each opposite side of the latch located at a point intermediate the latch and the at least one hinge, thereby increasing a sealing force between the lid and the upper frame member on each side of the soft-sided cooler, between the latch and the at least one hinge.

2. The soft-sided cooler according to claim 1, further comprising insulating material disposed between the exterior shell and the interior liner.

3. The soft-sided cooler according to claim 1, wherein the latch comprises a catch that secures to a lip on the lid and a tab that pivots at a pivot point supported by the lower frame member.

4. The soft-sided cooler according to claim 1, wherein the lower frame member is generally D-shaped, with a flat side and a generally arcuate side; wherein the lid is generally D-shaped, with a flat side and a generally arcuate side, and wherein the lid and the lower frame member are hingedly mounted on their respective flat sides.

5. The soft-sided cooler according to claim 1, wherein the lid sealing member surface, beginning along a front face of the soft-sided cooler, smoothly slopes outwardly toward the seat surface of the upper frame member and then, beginning along a side face of the soft-sided cooler, inwardly away from the seat surface of the upper frame member on each side of the latch, peaking at a point intermediate the latch and the at least one hinge and along the side face, to increase the scaling force between the lid and the upper frame on each side of the cooler, between the latch and the at least one hinge.

6. The soft-sided cooler according to claim 1, wherein the seat surface of the upper frame member, beginning along a front face of the soft-sided cooler smoothly slopes outwardly toward the lid and then, beginning along a side face of the soft-sided cooler, inwardly away from the lid on each side of the latch, peaking at a point intermediate the latch and the at least one hinge, to increase the sealing force between the lid and the upper frame member on each side of the cooler, between the latch and the at least one hinge.

7. The soft-sided cooler according to claim 1, wherein the lid sealing member surface and the seat surface both smoothly slope outwardly toward the other then inwardly away from the other on each side of the latch, peaking at a point intermediate the latch and the at least one hinge, increasing the sealing force between the lid and the upper frame member on each side of the cooler, between the latch and the at least one hinge.

8. The soft-sided cooler according to claim 1, wherein the seat surface of the upper frame member extends around the entire perimeter of the upper frame member.

9. The soft-sided cooler according to claim 1, wherein the lid sealing member surface extends around the entire perimeter of the lid.

10. The soft-sided cooler according to claim 1, wherein the lid comprises an outer lid member, an inner lid member, and a lid sealing member, wherein the lid sealing member surface is located on the lid sealing member.

* * * * *